US006608882B2

(12) United States Patent
Allen et al.

(10) Patent No.: US 6,608,882 B2
(45) Date of Patent: Aug. 19, 2003

(54) SYSTEM FOR, AND METHOD OF, IRRADIATING ARTICLES PARTICULARLY ARTICLES WITH VARIABLE DIMENSIONS

(75) Inventors: John Thomas Allen, San Diego, CA (US); George Michael Sullivan, San Diego, CA (US); Colin Brian Williams, La Jolla, CA (US)

(73) Assignee: Surebeam Corporation, San Diego, CA (US)

( * ) Notice: Subject to any disclaimer, the term of this patent is extended or adjusted under 35 U.S.C. 154(b) by 156 days.

(21) Appl. No.: 09/881,257

(22) Filed: Jun. 13, 2001

(65) Prior Publication Data

US 2002/0191739 A1 Dec. 19, 2002

(51) Int. Cl.[7] ..... G21K 5/00
(52) U.S. Cl. ..... 378/69; 378/64; 378/68
(58) Field of Search ..... 378/51, 55, 64, 378/68, 69, 119; 99/451; 250/491.1, 492.1, 493.1, 453.11, 454.11; 422/24

(56) References Cited

U.S. PATENT DOCUMENTS 5,838,760 A * 11/1998 Moses ..... 378/119
6,429,444 B1 * 8/2002 Korenev et al. ..... 250/492.3
6,504,898 B1 * 1/2003 Kotler ..... 378/64

* cited by examiner

*Primary Examiner*—Drew A. Dunn
*Assistant Examiner*—Therese Barber
(74) *Attorney, Agent, or Firm*—Fulwider Patton et al.; Ellsworth R. Roston

(57) ABSTRACT

Articles move on a conveyor mechanism in a first direction past a radiation source for an irradiation of the articles (by e.g., an electron beam, x-rays or gamma rays) by radiation moving in a second direction substantially perpendicular to the fires direction. The distance between the radiation source and the articles on the conveyor mechanism may be adjusted to provide for the irradiation of each position in the articles and to minimize the amount of the radiation which does not pass into the articles. The adjustment may be made by (1) adjusting the position of the radiation source in a particular direction corresponding to the direction of the radiation source and the articles on the conveyor mechanism, (2) actuating an individual one of a plurality of conveyors for moving the articles past the accelerator, each conveyor being separated from the radiation source by a distance different from the distance of the other conveyors from the radiation source or (3) repositioning the articles on a single conveyor in the particular direction. The distance between the radiation source and the conveyor mechanism may be varied dependent upon changes in the dimension of individual articles relative to the dimension of other articles, in a direction substantially perpendicular to (a) the direction of the radiation source and (b) the path of movement of the articles on the conveyor mechanism. Instead of irradiating a single article at any one time, the system may simultaneously irradiate a batch or stack of articles of the same or different sizes.

42 Claims, 3 Drawing Sheets

μp
10
12
16a
16b
16c
18
20
21
22a
22b
22c
23
30
32
34
36
37
38
39

SYSTEM FOR, AND METHOD OF, IRRADIATING ARTICLES PARTICULARLY ARTICLES WITH VARIABLE DIMENSIONS

This invention relates to apparatus for, and methods of, irradiating articles such as food, drugs and medical instruments and implements. The invention particularly relates to apparatus for, and methods of, applying radiation to articles of different dimensions or to batches or stacks of articles of the same or different dimensions in a manner such that substantially all of the radiation is used to sterilize the articles and such that all of the positions of the articles receive proper amounts of irradiation.

BACKGROUND OF THE PREFERRED EMBODIMENTS OF THE INVENTION

It has been known for some time that drugs and medical instruments and implements have to be sterilized so that they will not cause patients to become ill from harmful bacteria when they are applied to the patients. Systems have accordingly been provided for sterilizing drugs and medical instruments and implements. The drugs and the medical instruments and implements have then been stored in sterilized packages until they have been ready to be used.

In recent years, it has been discovered that foods can carry harmful bacteria if they are not processed properly or, even if they are processed properly, that the foods can harbor such harmful bacteria if they are not stored properly or retained under proper environmental conditions such as temperature. Some of these harmful bacteria can even be deadly.

For example, harmful bacteria have been discovered in recent years in hamburgers by one of the large hamburger chains. Such harmful bacteria have caused a number of purchasers of hamburgers from stores in the chain to become sick. As a result of this incident and several other similar incidents, it is now recommended that hamburgers should be cooked to at least a medium state rather than a medium rare or rare state.

Similarly, harmful bacteria have been found to exist in many chickens that are sold to the public. As a result of a number of incidents which have recently occurred, it is now recommended that all chickens be cooked so that no blood is visible in the cooked chickens.

To prevent incidents such as discussed in the previous paragraphs from occurring, various industries have now started to irradiate the foods that are sold to the public. This is true, for example, of hamburgers and chickens. It is also true of fruits, particularly fruits which are imported from foreign countries. Radiation has also been used for sprout inhibition, shelf life extension and modification in the properties of materials.

In previous years, gamma rays have generally been the preferred medium for irradiating articles. The gamma rays have been obtained from a suitable material such as cobalt and have been directed to the articles to be irradiated. The use of gamma rays has provided certain disadvantages. One disadvantage is that irradiation by gamma rays is slow. Another disadvantage is that irradiation by gamma rays is not precise. This results from the fact that the strength of the source (e.g. cobalt) of the gamma rays decreases over a period of time and that the gamma rays cannot be directed in a sharp beam to the articles to be sterilized. This prevents all of the gamma rays from being useful in irradiating the articles.

In recent years, electron beams have been directed to articles to irradiate the articles. Electron beams have certain advantages over the prior use of gamma rays to irradiate articles. One advantage is that irradiation by electron beams is fast. Another advantage is that irradiation by electron beams is relatively precise because the strength of the electron beam remains substantially constant even when the electron beam continues to be generated over a long period of time.

Irradiation by electron beams has a limitation which sometimes may be significant. Electrons in the electron beams have mass. As the electrons in the beam travel through the article to irradiate the article, they are slowed and eventually stopped by the mass of the article. This limits the thickness of articles which can be effectively irradiated by electron beams.

X-rays have been used to irradiate articles. X-rays are advantageous in that they have no mass. The x-rays are in the form of electromagnetic energy which penetrates the articles to be sterilized. Since the x-rays have no mass, they are effective in irradiating articles with increased thicknesses. These significant thicknesses are considerably greater than the thicknesses of the articles which can be irradiated by other forms of energy such as electron beams.

There is one disadvantage, among others, in the use of x-rays to irradiate an article. This results from the fact that a considerable amount of energy remains in the x-rays after the x-rays have passed through the article. The energy remaining in the x-rays after the passage of the x-rays through the article is wasted because it has not been used for any useful purpose. Co-pending U.S. patent application Ser. No. 09/753,287 filed by applicants on Dec. 29, 2000 for a System for, and Method of, Irradiating Articles With X-Ray Beam and assigned of record to the assignee of record of this application discloses and claims a system for utilizing substantially all of the energy from the x-rays to irradiate articles.

There is another disadvantage in the use of x-rays to irradiate articles. The x-rays are generally produced by directing electrons to a converter which converts the electrons to x-rays. However, instead of constituting a focused beam as in the case of the electrons, the x-rays travel in different directions from the converter. A significant percentage of the x-rays move past the articles being irradiated without passing into the articles. This results in an inefficiency in the operation of the system since these x-rays do not provide any irradiation of the articles.

The processing inefficiency becomes particularly pronounced when the system is used with articles of different sizes. When the articles are relatively small, an increased amount of the radiation from the source moves past the articles without passing into the articles. When the articles are relatively large, not all of the volume in the articles receives a sufficient amount of x-rays from the source to become properly sterilized.

BRIEF DESCRIPTION OF PREFERRED EMBODIMENTS OF THE INVENTION

This invention provides a system for, and method of, passing radiation to an article so that an increase percentage of the x-rays passes into the article and the article becomes properly processed by the radiation. The system and method of this invention accomplish this by varying the distance between the position of generating the radiation and the position of individual articles, this variation being dependent upon changes in dimensions of the articles relative to the dimensions of other articles. In one preferred embodiment, the radiation source is displaced toward or away from the articles by a distance dependent upon the changes in the dimensions of the individual articles relative to the dimensions of the other articles.

In another preferred embodiment, the articles are moved on conveyors toward or away from the radiation source by a distance dependent upon the changes in the dimension of the individual articles relative to the dimensions of the other articles. In a third preferred embodiment, the individual articles are moved on the conveyor in a direction to vary the distance between the articles and the source of radiation.

Instead of processing a single article at any one time, the system may simultaneously process a plurality of articles which are disposed in a batch or in a stacked relationship.

In the preferred embodiments of the invention articles move on a conveyor mechanism in a first direction past a radiation source for a processing of the articles by radiation (e.g. gamma rays, electron beam or x-rays). The radiation moves in a second direction substantially perpendicular to the direction of movement of the conveyor. However, the radiation often has a component of movement in a direction perpendicular to the second direction. In effect, the radiation is scattered as a result of this perpendicular component of movement. Some radiation may move in the transverse direction past the articles without irradiating the articles. The distance between the radiation source and the articles on the conveyor mechanism may be adjusted to maximize the movement of the radiation to position in the article and to minimize the amount of the radiation which does not pass into the articles.

The adjustment may be made by (1) adjusting the position of the radiation source in a particular direction constituting the direction of the radiation source or (2) actuating an individual one of a plurality of conveyors for moving the articles past the radiation source, each conveyor being separated from the radiation by a distance different from the distance of the other conveyors from the radiation source, or (3) repositioning the articles on the conveyor in the particular direction. The distance between the radiation source and the conveyor mechanism may be varied dependent upon the variations in the dimension of the articles in a direction substantially perpendicular to (a) the direction of the radiation source and (b) the path of movement of the articles on the conveyor mechanism. Instead of irradiating a single article at any one time, the system may simultaneously irradiate a batch or stack of articles of the same or different sizes. It should be appreciated that the radiation source may be considered to include a converter for converting an electron beam to x-rays.

DETAILED DESCRIPTION OF PREFERRED EMBODIMENTS OF THE INVENTION

Systems are now being adopted for irradiating various types of articles including food products by radiating the articles. When the food products are relatively thin in the direction of the flow of the radiating energy, electron beams are now being used. The electron beams have a special utility when the articles being irradiated have a thickness within particular limits. For example, electron beams are used to irradiate flat hamburger patties weighing one quarter of a pound (¼ lb.) or one half of a pound (½ lb.) The electron beams are particularly effective when the articles are irradiated from opposite sides of the articles.

Electron beams are generally not effective in irradiating articles that are too thick. This results from the fact that the electron beams have mass. This mass causes the electrons to decelerate as they pass through the articles being irradiated. Thus, the interior of the articles does not receive a dose sufficient to kill bacteria. This is true even when the electron beams enter into the article from two (2) opposite sides of the article.

X-rays are often used to irradiate articles having a thickness greater than what is effective for electrons. X-rays are advantageous under such circumstances because they constitute electromagnetic energy which does not have any mass. A considerable disadvantage is that a considerable amount of the x-ray energy is not utilized in irradiating articles when the thickness of the articles is (a) above the range where the articles can be sterilized by electron beams (b) but below the range where the full intensity of the radiation from the x-rays can be efficiently utilized in irradiating the articles.

In U.S. patent application Ser. No. 09/753,287 filed by applicants on Dec. 29, 2000, for a System For, And Method of, Irradiating Articles With X-Ray Beam and assigned of record to the assignee of record of this application, a system and method are disclosed for providing for an efficient use of the full intensity of x-rays in processing the articles initially to the full intensity of the x-ray radiation from an accelerator and subsequently to the reduced intensity remaining in the x-rays after the initial radiation of the articles by the x-rays. The initial and subsequent radiation are provided in a way so that the number of articles radiated per unit of time is not reduced relative to the number of units which are radiated per unit of time when only the initial radiations are provided.

Figures 1A, 1B, 2A, 2B, 2C:
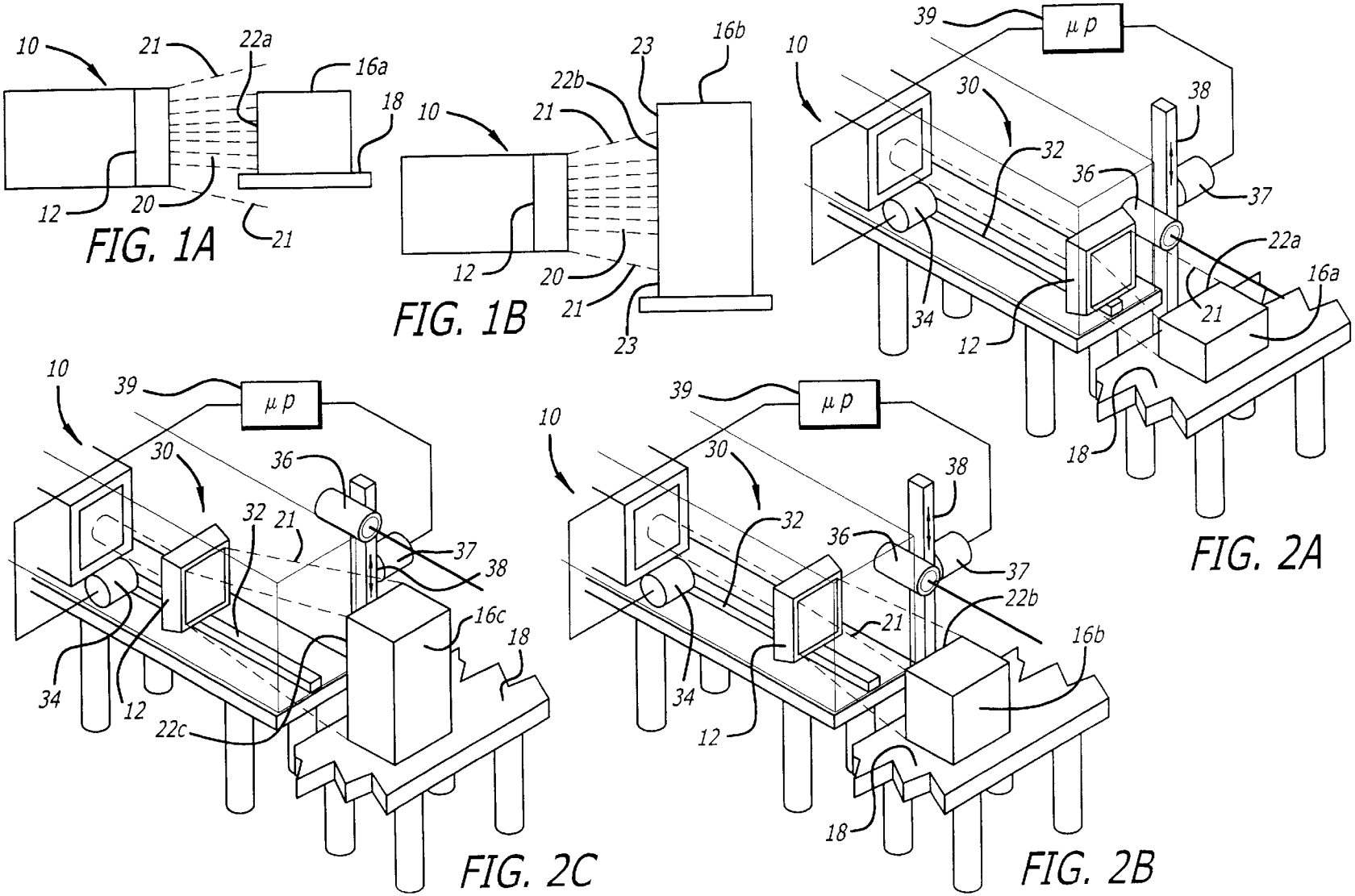
FIGS. 1A and 1B are schematic elevational views showing in FIG. 1A how radiation (e.g. x-rays) moves toward an article of small dimensions on a conveyor without passing through the article and showing in FIG. 1B how x-rays fail to irradiate all of the volume in an article of large dimensions on the conveyor.
FIGS. 2A, 2B and 2C are schematic perspective views showing how the position of a radiation source (e.g. x-rays) is adjusted to provide for the passage of the x-rays to every position in articles of different dimensions and to prevent little, if any, of the x-rays from moving past the articles without moving into the articles.

There is another disadvantage when x-rays are used to process articles. This may be seen from the schematic representations in FIGS. 1A and 1B. In FIG. 1A, a radiation source generally indicated at 10 produces a beam of electrons and impinges the electrons in the beam on a converter 12 (e.g. brehmstahling) made from a suitable material such as tungsten. The converter 12 converts the electrons to x-rays. This is well known in the art.

As will be seen, when the accelerator 10 has the position shown in FIG. 1A, some of the x-rays pass to an article 16*a* of a relatively small height on a conveyor 18 in a direction corresponding to the direction of the electron beam. This is indicated at 20 in FIGS. 1A and 1B. This direction is substantially perpendicular to the direction in which the conveyor 18 moves the article 16 past the electron beam from the accelerator 12, this direction being perpendicular to the plane of the paper. These x-rays pass through the article 16*a* and irradiate the article. However, some of the x-rays are scattered, as indicated at 21. The scattered x-rays move past the article 16*a* without passing into the article. These x-rays 21 have no effect in irradiating the article 16*a*. This is inefficient.

When an article has a relatively large height as shown in FIG. 1B and the converter 12 is the same distance from the article as the distance shown in FIG. 1A, the x-rays pass to the article but fail to irradiate all of the positions of the article. This is indicated at 23 in FIG. 1B. This is undesirable since not all of the harmful bacteria in the article may be killed. The harmful bacteria may then multiply in the article 16 and injure or kill individuals when the article is a food item and the individuals eat the food item.

Although the preferred embodiments are described with particular reference to x-rays, it should be appreciated that different types of radiation (e.g. gamma rays and electron beams) can be used without departing from the scope of the invention. Furthermore, although the articles being sterilized may be generally referred to as food products, it will be appreciated that other types of articles (e.g. drugs, medical instruments and medical implements) may be irradiated without departing from the scope of the invention. Furthermore, the articles may be irradiated to provide disinfestation, sprout inhibition, shelf life extension and modification of properties of materials without departing from the scope of the invention.

As an initial step, the accelerator 10 may be centered so that the x-rays 20 traveling directly to the article 16 are centered relative to the converter 12. This will provide for the scattered x-rays 21 to pass on a balanced basis to positions into the article at positions above and below the positions where the directed x-rays pass into the articles. It will be appreciated that the radiation source 10 does not have to be centered relative to the converter 12 to accomplish the purposes of this invention.

FIG. 2A schematically shows the paths of different x-rays when an article 16*a* on the conveyor 18 has a relatively small height and the converter 12 is an optimal distance from the article. The height of the article 16*a* is the direction substantially perpendicular to the direction of the electron beam from the accelerator 10 and substantially perpendicular to the path of movement of the article 16*a* on the conveyor 18. It is indicated by an external wall 22*a*. As will be seen in FIG. 2A, substantially all of the x-rays including the directed x-rays 20 and the scattered x-rays 21 pass into the article 16*a*. Little, if any, of the x-rays 21 move past the article 16*a* without passing into the article. Furthermore, the x-rays 20 and 21 irradiate all of the positions in the article 16*a*.

When an article 16*b* is moderately large as shown in FIG. 2B, at least with respect to the external wall 22*b* facing the converter 12, the distance between the wall 22*b* of the article 16*b* and the converter 12 is increased. At an optimal distance, substantially all of the x-rays including the scattered x-rays 21 pass into the article 16*b*. Little, if any, of the x-rays 21 move past the article 16*b* without passing into the article. Furthermore, the x-rays 20 and 21 irradiate all of the positions in the article 16*b*.

When an article 16*c* is relatively large as shown in FIG. 2C, at least with respect to the external wall 22*c* facing the converter 12, the distance between the wall 22*c* of the article and the converter 12 is further increased. At an optimal distance, substantially all of the x-rays including the scattered x-rays 21 pass into the article 16*c*. Little, if any, of the x-rays move past the article 16*c* without passing into the article. Furthermore, the x-rays 20 and 21 irradiate all of the positions in the article 16.

This invention provides different preferred embodiments of a system for positioning the article 16 relative to the converter 12, or positioning the converter relative to the article, so that all of the positions in the article are properly processed and so that little, if any, x-ray energy moves past the article without passing into the article. In the embodiment shown in FIGS. 2A–2C, the converter 12 is provided with different positions depending upon the dimension of the wall 22 in the article 16. For example, when the dimension of the wall 22*a* in the article 16*a* is relatively small as shown in FIG. 2A, the converter 12 is positioned relatively close to the article. When the dimension of the wall 22*b* in the article 16*b* is moderate, the converter 12 is disposed at a moderate distance from the article as shown in FIG. 2B. When the dimension of the wall 22*c* in the article 16*c* is relatively large, the converter is at a relatively great distance from the article as shown in FIG. 2C. In this way, the x-rays pass into all of the positions of the article 16 and the x-rays do not move past the articles without passing into the articles.

In the embodiments shown in FIGS. 2A–2C, a system generally indicated at 30 is provided for moving the converter 12 on an axis corresponding to the axis of the accelerator 10. The movement of the converter 12 is provided on a track 32 as by a motor 34 in a direction relative to the face 22 of the article 16 so that all of the positions in of the article 14 are irradiated by the x-rays and so that little, if any, of the x-rays is lost by moving past the article 16 without passing into the article. The track 32 may be disposed in a direction corresponding to the direction of the electron beam in the accelerator 10.

For example, if the x-rays move past the article 16 without passing into the article, the converter 12 is moved in a direction to decrease the distance between the converter and the article until substantially all of the x-rays pass into the article. On the other hand, when the face 22 of the article 16 is relatively large, the x-rays may not be able to irradiate all of the positions in the article 16. The converter 12 is accordingly moved in a direction away from the article 16 so that substantially all of the x-rays, and particularly the scattered x-rays 21, will be able to pass into the article and irradiate all of the different positions in the article and so that little, if any, of the x-rays will move past the article 16 without passing into the article. The converter 12 and the face 22 of the article 16 are preferably substantially parallel to each other.

The relative dimensions of the face 22 of the articles 16 may be determined by a detector 36 in a manner well known in the art. For example, the detector 36 my be optical, mechanical or electrical. The detector 36 may be movable by a motor 37 in opposite vertical directions indicated by arrows 38 so that the detector can determine the top of the article 16 and provide signals indicating this determination. The signals from the detector 36 are introduced to a processor such as a microprocessor 39 which produces instructions to the motor 34 to drive the converter 12 on the track 32.

Figure 4:
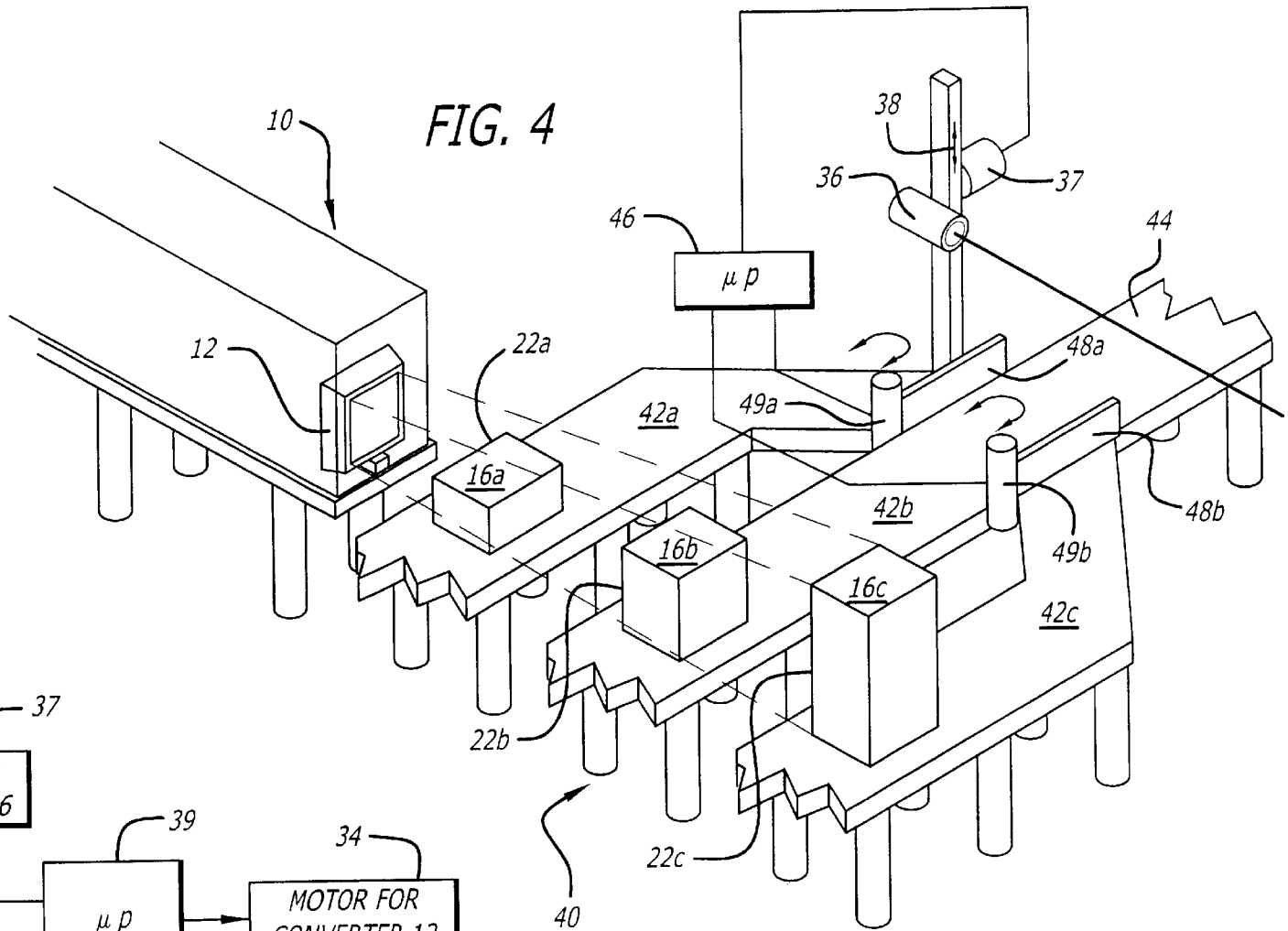
FIG. 4 is a schematic perspective view showing how articles of different dimensions are transported by individual ones of a plurality of conveyors, each displaced at a different distance from the radiation source (e.g. x-rays) than the others, to provide for the passage of the x-rays to every position in the articles of the different dimensions and to prevent little, if any, of the x-rays from moving past the articles without passing into the articles.

FIG. 4 schematically illustrates a second embodiment, generally indicated at 40, of the invention. In this embodiment, the article 16 is moved toward or away from the converter 12 dependent upon the signals provided by the detector 36 to indicate the dimensions of the face 22 of the article. The article 16 may be moved in a direction corresponding to the direction of the accelerator 10 by disposing the article 16 on a selected one of a plurality of conveyors 42*a*, 42*b* and 42*c*, each of which is constructed to transport the article 16 past the converter 12 in a direction substantially perpendicular to the converter. The individual one of the conveyers 42*a*, 42*b* and 42*c* selected to transport the articles 20 at any instant is dependent upon the dimensions of the face 22 of the article 16, as indicated by the signals from the detector 36. Although three (3) conveyors 42*a*, 42*b* and 42*c* are shown in FIG. 3, it will be appreciated that any number of different conveyors can be provided.

It will be appreciated that the conveyors 42, 42*b* and 42*c* may diverge from a common conveyor 44 which is disposed at a position before the position at which the articles are irradiated by the accelerator 10. A microprocessor 46 responsive to the signals from the detector 36 controls the particular one of the conveyors 42*a*, 42*b* and 42*c* that receives each individual one of the articles.

The microprocessor 46 controls the actuation of gates 48*a* and 48*b* which are respectively pivotable at fulcrum positions 49*a* and 49*b*. When the gates 48*a* and 48*b* have the positions shown in FIG. 4, the articles 16*a* move past the accelerator 10 on the conveyor 42*b*. When the gate 48*a* is pivoted in a clockwise direction so that it extends across the width of the conveyor 42*b*, the conveyor 42*b* is blocked and the conveyor 42*a* is opened so that the articles 16*b* move on the conveyor 42*a* past the accelerator 10. Similarly, when the gate 48*b* is pivoted in a counterclockwise direction so that it extends across the width of the conveyor 42*b*, the conveyor 42*b* is blocked and the conveyor 42*c* is opened so that the articles 16*c* move on the conveyor 42*c* past the accelerator 10.

Figure 3:
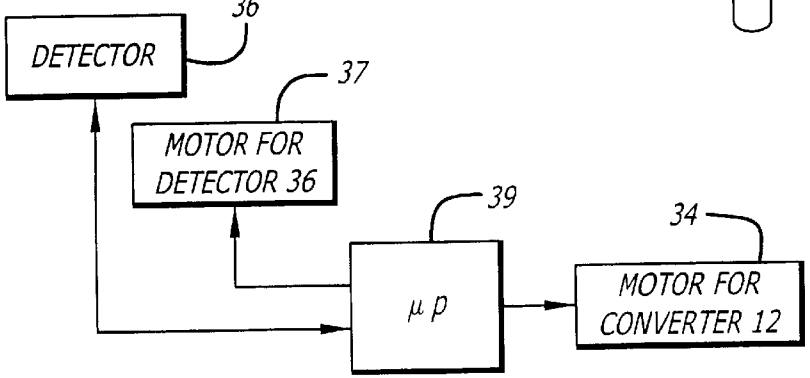
FIG. 3 is a schematic block diagram of electrical circuitry for processing signals produced by the system of FIGS. 2A–2C to position the x-ray source in FIGS. 2A–2C from the article in the conveyor by a distance dependent upon changes in the different dimensions of the articles.

As shown schematically in FIG. 3, the conveyor 42*a* is constructed to receive articles 16*a* having the dimensions of the first face 22*a* in FIG. 1A and the conveyor 42*b* is constructed to receive the articles 16*b* having the dimensions of the second face 22*b*. Since the face 22*a* of the article 16*a* is smaller than the face 22*b* of the article 16*b*, the conveyor 42*a* disposes the face 22*a* of the article 16*a* closer to the converter 12 than the conveyor 42*b* disposes the face 22*b* of the article 16*b*. Similarly, the conveyor 42*b* disposes the face 22*b* of the article 16*b* closer to the converter 12 than the conveyor 42*c* disposes the face 22*c* of the article 16*c*. The reason is that the face 22*b* of the article 16*b* is smaller than the face 22*c* of the article 16*c*. The articles 16*a*, 16*b* and 16*c* are schematically illustrated in FIG. 4.

Instead of providing the detector 36 to determine the dimensions of the article 16, the dimensions of the article 16 may be programmed into the microprocessor 46. Thus, as each article 16 moves past the radiation source 10, the microprocessor programs the system to adjust the distance between the radiation source 10 and the article 16.

Figure 5:
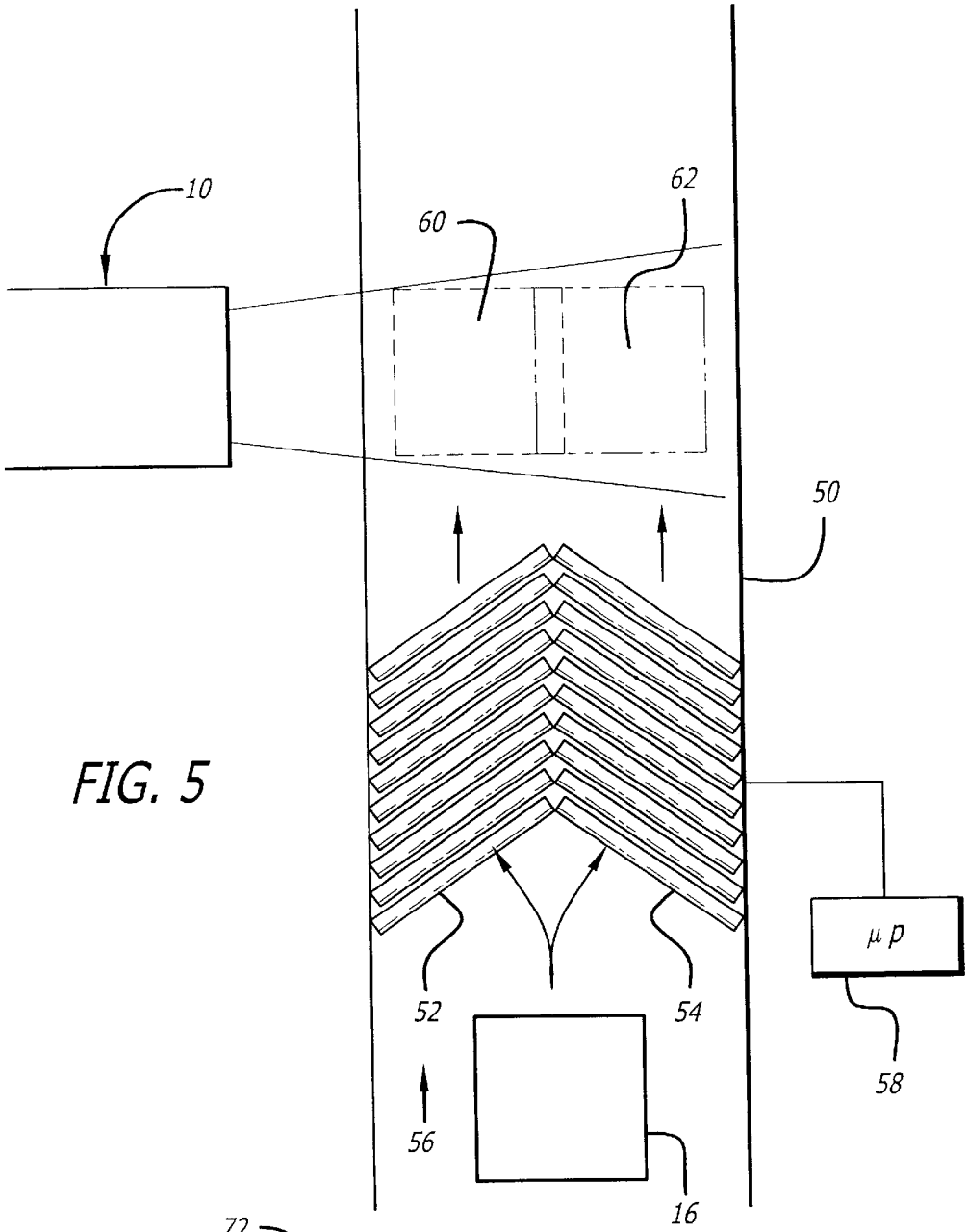
FIG. 5 is a schematic plan view showing how articles of different dimensions are moved on a single conveyor in a direction corresponding to the direction of the radiation source (e.g. x-rays) to provide for the passage of the x-rays to every position in the articles of the different dimensions and to prevent little, if any, of the x-rays from moving past the articles without passing into the articles.

FIG. 5 illustrates another preferred embodiment of the invention. In this embodiment, the articles 16 are disposed on a single conveyor 16. The conveyor 50 is provided with rollers such as rollers 52 and 54. The rollers 52 are disposed in a transverse relationship to the direction 56 of movement of the conveyor so that the rollers provide the article 16 with a component of movement in the direction 56 and a component of movement toward the radiation source 10. The rollers 54 are disposed in a transverse relationship to the direction 56 of movement of the conveyor 50 so that the rollers provide the article 16 with a component of movement in the direction 50 and a component of movement of the article 10 away from the radiation source 10.

When it is determined as by a microprocessor 58 that the article 16 has to be moved toward the radiation source 10, the microprocessor causes the rollers 52 to be activated for a period of time dependent upon the distance that the article 16 has to be moved toward the left in FIG. 5. This causes the article 16 to have a position indicated in broken lines at 60 in FIG. 5 as the article moves past the radiation source 10.

When it is determined as by the microprocessor 58 that the article 16 has to be moved away from the radiation source 10, the microprocessor causes the rollers 54 to be activated for a period of time dependent upon the distance that the article 16 has to be moved toward the right in FIG. 5. This causes the article 16 to have a position indicated in broken lines at 62 in FIG. 5 as the article moves past the radiation source 10.

Figure 6:
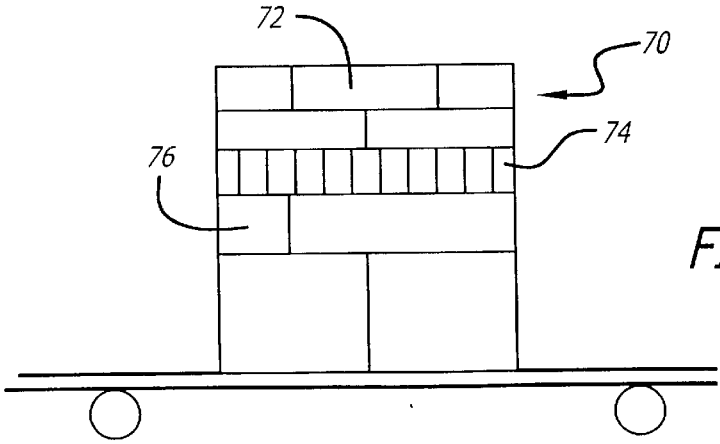
FIG. 6 is a perspective view schematically illustrating how a batch or stack may be formed by a plurality of articles of the same or different dimensions to provide for a simultaneous irradiation of the articles in the batch or stack by the system constituting the preferred embodiments of this invention.

FIG. 6 illustrates how the system shown in FIGS. 2–5 may process a plurality of articles simultaneously instead of processing a single article at a time as described above. As shown in FIG. 6, a batch or stack of articles is generally indicated at 70. The batch or stack 70 may be formed from a plurality of articles 72, 74, 76, etc., all of which may be of the same dimensions or some of which may have different dimensions. The system shown in FIGS. 2–5 determine, or receive information relative to, the batch or stack 70 to determine the positioning of the batch or stack 70 relative to the radiation source 10. It will be accordingly be seen that the term "articles" as used in the claims is intended to include individual articles such as shown in FIGS. 2–5 and batches or stacks of articles of the same or different dimensions such as shown in FIG. 6.

Although this invention has been disclosed and illustrated with reference to particular preferred embodiments, the principles involved are susceptible for use in numerous other embodiments which will be apparent to persons of ordinary skill in the art. The invention is, therefore, to be limited only as indicated by the scope of the appended claims.

Although x-rays may be sometimes specifically discussed in the specification as the source of radiation in different preferred embodiments of the invention, such forms of electron magnetic energy as electron beams, x-rays and gamma rays may be considered as equivalent forms of radiation from the standpoint of the language of the claims.

What is claimed is:

1. In combination for irradiating articles where individual articles have changes in dimensions relative to the dimensions of other articles, including, a radiation source for providing radiation, a device for indicating the changes in the dimensions of the individual articles and for providing signals indicative of such dimensions, dependent upon the signals from the device, a drive member responsive to the signals from the device for displacing at least one of the radiation source and the articles in a particular direction, dependent upon the signals from the device, defining the distance between the radiation source and the articles, and a conveyor for moving the articles past the radiation source to obtain an irradiation of the articles by the radiation from the source.

2. In a combination as set forth in claim 1 wherein the radiation source provides radiation having particular characteristics in a particular direction transverse to the direction defining the distance between the radiation source and the articles and wherein the individual articles have changes in dimensions in the particular direction relative to the dimensions of the other articles and wherein the device indicates the dimensions in the particular direction for the individual ones of the articles and wherein dependent upon the signals from the device, the drive member displaces the at least one of the radiation source and the articles in the particular direction.

3. In a combination as set forth in claim 1 wherein the radiation source constitutes the at least one of the radiation source and the articles.

4. In a combination as set forth in claim 1 wherein each of the articles constitutes the at least one of the radiation source and the articles.

5. In a combination as set forth in claim 1 wherein the radiation from the source emanates from the source in directions transverse to the particular direction and wherein the at least one of the radiation source and the articles is displaceable in the particular direction dependent upon the changes in the dimension of the individual ones of the articles relative to the dimensions of the other articles in a direction substantially perpendicular to the particular direction.

6. In a combination as set forth in claim 5 wherein the at least one of the radiation source and the individual articles is displaced toward the other one of the radiation source and the individual articles dependent upon decreases in the dimension of the individual articles in the substantially perpendicular direction relative to the dimension of the other articles and wherein the at least one of the radiation source and the individual articles is displaced away from the other one of the radiation source and the individual articles dependent upon increases in the dimension of the individual articles in the substantially perpendicular direction relative to the dimensions of the other articles.

7. In a combination as set forth in claim 1 wherein a plurality of conveyors are provided for moving the articles past the radiation source for an irradiation of the articles by the x-rays from the radiation source and wherein each of the conveyors is displaced from the radiation source by a different distance than the distance of the displacement of the other ones of the conveyors from the radiation source and wherein a microprocessor selects a particular one of the conveyors dependent upon the changes in dimensions of the individual articles in the perpendicular direction relative to the dimensions of the other articles.

8. In a combination as set forth in claim 7 wherein the conveyor selected at each instant to displace the individual articles from the radiation source is displaced from the individual articles by a distance related to the changes in the dimensions of the individual articles in the perpendicular direction relative to the dimensions of the other articles.

9. In a combination as set forth in claim 1 wherein a single conveyor is provided and wherein the articles are displaced on the conveyor toward or away from the radiation source by a distance dependent upon the changes in the dimensions of the individual one of the articles relative to the dimensions of the other articles.

10. In combination for irradiating individual articles where the individual articles have changes in dimensions relative to other articles, including a radiation source disposed in a particular direction to emit radiation in the particular direction with some of the radiation having a directional component perpendicular to the particular direction, a plurality of conveyor paths each disposed to convey the articles past the radiation source in a direction substantially perpendicular to the particular direction of the emitted radiation at a distance from the radiation source different from the distance of the other conveyor paths from the radiation source, a device for indicating the changes in dimensions of the individual articles in the perpendicular direction relative to the dimensions of the other articles, and apparatus responsive to the determination by the device of the changes in the dimensions of the individual articles relative to the dimensions of the other articles in the perpendicular direction for providing for an activation of an individual one of the conveyor paths dependent upon the indication by the device to obtain a movement of the individual articles on the individual one of the conveyor paths past the radiation source for an irradiation of the individual articles on the conveyor path by the radiation source.

11. In a combination as set forth in claim 10 wherein the activating apparatus provides for an activation of the individual one of the conveyors displaced from the radiation source by a distance related to the changes in the dimensions of the individual articles relative to the dimensions of the other articles in the perpendicular direction.

12. In a combination as set forth in claim 10 wherein the activating apparatus provides for an activation of the individual one of the conveyor paths, which individual ones of the conveyor paths provide for an optimal emanation of the radiation from the source to the individual articles dependent upon the indication by the device of the changes in the dimensions of the individual articles in the particular direction relative to the dimensions of the other articles.

13. In a combination as set forth in claim 10 wherein the activating apparatus provides for an activation of an individual one of the conveyor paths, which individual one of the conveyor paths provides for an irradiation of each position in the individual articles by the radiation from the source and for a minimal passage of the radiation from the source past the individual articles without passing into the individual articles.

14. In combination for irradiating individual articles having changes in dimensions relative to the dimensions of other articles, including a source of radiation, a conveyor mechanism for moving the individual articles past the radiation from the source to obtain an irradiation of the individual articles on the conveyor mechanism, and a positioning mechanism operatively coupled to at least a particular one of the conveyor mechanism and the radiation source for varying the dimensional relationship between the radiation source and the individual articles on the conveyor mechanism dependent upon the dimensions of the individual articles relative to the dimensions of the other articles.

15. In a combination as set forth in claims 14 wherein the radiation source is moved in a direction toward and away from the conveyor mechanism dependent upon the dimensions of the individual articles on the conveyor mechanism relative to the dimensions of the other articles.

16. In a combination as set forth in claim 14 wherein the disposition of the conveyor mechanism relative to the radiation source is varied dependent upon the dimensions of the individual articles on the conveyor mechanism relative to the dimensions of the other articles.

17. In combination as set forth in claim 14 wherein a device provides signals representing the changes in the dimensions of the individual articles on the conveyor mechanism relative to the dimensions of the other articles and wherein the positioning mechanism is responsive to the signals from the device for varying the distance between the radiation source and the individual articles on the conveyor mechanism in the direction toward and away from the conveyor mechanism.

18. In a combination as set forth in claim 15 wherein the positioning mechanism is responsive to the signals from the device for displacing the radiation source in a direction to vary the distance between the radiation source and the individual articles on the conveyor mechanism.

19. In a combination as set forth in claim 15 wherein the positioning mechanism is responsive to the signals from the device for displacing the conveyor mechanism in a direction to vary the distance between the radiation source and the individual articles on the conveyor mechanism.

20. In a combination as set forth in claim 15 wherein a single conveyor mechanism is provided and wherein the positioning mechanism is responsive to the signals from the device for displacing the individual articles on the conveyor mechanism in a direction to vary the distance between the radiation source and the articles on the conveyor mechanism.

21. A method of irradiating individual articles where the individual articles have changes in dimensions relative to the dimensions of other articles, including the steps of:

providing a source of radiation, providing a conveyor mechanism for conveying the articles past the radiation source providing for the direction of the radiation to the articles on the conveyor mechanism during the conveyance of the articles by the conveyor mechanism, determining changes in the dimensions of the individual articles relative to the dimensions of other articles, dependent upon the determined changes in the dimensions of the individual articles relative to the dimensions of the other articles, and adjusting the relative distance between the radiation source and the articles on the conveyor mechanism.

22. A method as set forth in claim 21 wherein dependent upon the changes in the dimensions of the individual articles on the conveyor mechanism relative to the dimensions of the other articles, the step of adjusting involves an adjustment in the position of the radiation source in a direction to vary the distance between the radiation source and the individual articles on the conveyor mechanism.

23. A method as set forth in claim 21 wherein dependent upon the changes in the dimensions of the individual articles on the conveyor mechanism relative to the dimensions of the other articles, the step of adjusting involves a displacement of the conveyor mechanism to vary the distance between the radiation source and the articles on the conveyor mechanism.

24. A method as set forth in claim 21 wherein the step of adjusting involves a selection of an individual one of a plurality of conveyor mechanisms each displaced from the radiation source by a particular distance different from the displacement of the other ones of the conveyor mechanisms from the radiation source and wherein the selected one of the conveyor mechanisms conveys the individual articles past the device.

25. A method as set forth in claim 21 wherein a single conveyor mechanism is provided and wherein the step of adjusting involves a movement of the individual articles on the conveyor mechanism to vary the distance between the radiation source and the individual articles on the conveyor mechanism.

26. A method as set forth in claim 21 wherein dependent upon the indications of the changes in the dimensions of the individual articles relative to the dimensions of the other articles, the step of adjusting includes the step of indicating the dimensions of the individual articles on the conveyor mechanism in a direction transverse to the distance between the radiation source and the articles on the conveyor mechanism and includes the step of varying the distance between the radiation source and the individual articles on the conveyor mechanism.

27. A method as set forth in claim 21 wherein the radiation source includes a source of electrons and a converter responsive to the electrons for producing x-rays and wherein the step of adjusting includes the step of adjusting the position of the converter to vary the distance between the converter and the individual articles on the conveyor mechanism.

28. A method as set forth in claim 25 wherein the step of adjusting includes the step of adjusting the position of the individual articles on the conveyor mechanism in a direction to vary the distance between the radiation source and the conveyor mechanism.

29. A method as set forth in claim 23 wherein the conveyor mechanism includes a plurality of conveyors each displaced from the radiation source by a distance different from the displacement of the other ones of the conveyors from the radiation source and wherein each of the conveyors is individually operative to move the articles on the conveyor past the radiation source for an irradiation of the articles by the radiation source and wherein the step of varying includes the step of activating an individual one of the conveyor mechanisms at each instant to vary the distance between the converter and the articles dependent upon the activation of the individual one of the conveyors.

30. A method of irradiating individual articles with x-rays where the individual articles have changes in dimensions for receiving the radiation relative to the dimensions of other articles, including the steps of:

providing a conveyor mechanism for conveying the articles, providing radiation and directing the radiation to the individual articles on the conveyor mechanism, determining changes in the dimensions of the face of individual articles closest to the radiation source, and providing for changes in the distance between the individual articles and the conveyor mechanism in accordance with the changes determined in the dimensions of the face of individual articles closest to the radiation source.

31. A method as set forth in claim 30 wherein an electron beam is directed toward the face of the individual articles on the conveyor mechanism as the individual articles move on the conveyor mechanism past the radiation and wherein the electrons in the beam are converted to x-rays and wherein the dimensions of the x-rays are varied dependent upon the changes in the dimensions of the articles faces of the articles closest to the radiation source relative to the dimensions of the other articles.

32. A method as set forth in claim 30 wherein an electron beam is formed from electrons and is directed toward the face of the individual articles on the conveyor mechanism as the individual articles move on the conveyor mechanism past the radiation and wherein the x-rays are produced by introducing the electrons in the electron beam to a converter and wherein dependent upon the changes in the dimensions of the face of the articles, the position of the converter is varied in the same direction as the electron beam to change the distance between the converter and the face closest on the individual articles to the converter.

33. A method as set forth in claim 31 wherein the electron beam is directed toward the face of the individual articles on the conveyor as the individual articles move on the conveyor past the electron beam and wherein the x-rays are produced by introducing the electrons in the electron beam to a converter to x-rays and wherein the disposition of the individual articles on the conveyor during the movement of the individual articles past the converter is varied in the same direction as the electron beam to change the distance between the converter and the face of the individual articles dependent upon the changes in the dimensions of the face receiving the radiation in the individual articles.

34. A method as set forth in claim 33 wherein the conveyor constitutes a single conveyor.

35. A method as set forth in claim 33 wherein the conveyor constitutes a plurality of conveyor mechanisms each displaced by a different distance from the radiation source and wherein an individual one of the conveyor mechanisms is activated at each instant dependent upon the changes in the dimensions of the face receiving the radiation in the articles.

36. A method as set forth in claim 35 wherein the dimensions of the face of the individual articles are indicated and wherein dependent upon the changes in the dimensions of the face of the individual articles relative to the dimensions of the other articles, the change is made in the position of the converter to provide for a processing of each position in the articles by the x-rays and to prevent the x-rays from moving past the face of the articles without passing into the articles.

37. A method of irradiating individual articles where the individual articles have faces with changes in dimensions relative to the dimensions of other articles, including the steps of:

producing x-rays, conveying the individual articles past the x-rays for a processing of the individual articles by the x-rays, and determining changes in the dimensions of the faces of the individual articles, dependent upon the determined changes in the dimensions of the faces of the individual articles, and providing for an adjustment in the space occupied by the x-rays at the faces of the individual articles closest to the production of the x-rays to obtain a processing relative to the dimensions of the faces of the other articles.

38. A method as set forth in claim 37, including the steps of:

indicating the changes in the dimensions of the faces of the individual articles relative to the dimensions of the faces of the other articles, and adjusting the space occupied by the x-rays at the face of the articles closest to the production of the x-rays, such adjustments being dependent upon the changes in the dimensions of the face of the individual articles relative to the dimensions of the faces of the other articles.

39. A method as set forth in claim 37, including the step of:

adjusting the distance between the production of the x-rays and the disposition of the individual articles in the conveyance of the individual articles past the x-rays, such adjustment being dependent upon changes in the dimensions of the face of the individual articles relative to the dimensions of the face of the other articles.

40. A method as set forth in claim 37 wherein the adjustment is made by adjusting the disposition of the articles in the conveyance of the articles past the x-rays.

41. A method as set forth in claim 37 wherein the distance adjustment is made by adjusting the position where the x-rays are produced.

42. A method as set forth in claim 37 wherein the articles are moved on a single conveyor and wherein dependent upon the changes in the dimensions on the face of the individual articles receiving the x-rays relative to the dimensions of the faces of the other articles, the articles are adjusted in position on the single conveyor in a direction corresponding to the direction of the x-rays.

* * * * *

UNITED STATES PATENT AND TRADEMARK OFFICE

CERTIFICATE OF CORRECTION

PATENT NO. : 6,608,882 B2 
DATED : August 19, 2003
INVENTOR(S) : John Thomas Allen et al.

It is certified that error appears in the above-identified patent and that said Letters Patent is hereby corrected as shown below:

Column 14,
Line 19, after "x-rays", delete "and".
Line 23, after "articles", delete "and" and continue that paragraphs with lines 25-29.

Signed and Sealed this

Second Day of December, 2003

JAMES E. ROGAN
*Director of the United States Patent and Trademark Office*